US008238584B2

(12) United States Patent
Saito et al.

(10) Patent No.: US 8,238,584 B2
(45) Date of Patent: Aug. 7, 2012

(54) VOICE SIGNAL TRANSMITTING/RECEIVING APPARATUS

(75) Inventors: Kosuke Saito, Hamamatsu (JP); Katsuichi Osakabe, Hamamatsu (JP); Shinji Aoshima, Iwata (JP); Toshiaki Ishibashi, Fukuroi (JP); Yuichiro Suenaga, Hamamatsu (JP); Chikara Kobayashi, Hamamatsu (JP)

(73) Assignee: Yamaha Corporation (JP)

( * ) Notice: Subject to any disclaimer, the term of this patent is extended or adjusted under 35 U.S.C. 154(b) by 1028 days.

(21) Appl. No.: 12/092,352

(22) PCT Filed: Mar. 9, 2006

(86) PCT No.: PCT/JP2006/305196

§ 371 (c)(1), (2), (4) Date: May 1, 2008

(87) PCT Pub. No.: WO2007/052374

PCT Pub. Date: May 10, 2007

(65) Prior Publication Data

US 2009/0252364 A1 Oct. 8, 2009

(30) Foreign Application Priority Data

Nov. 2, 2005 (JP) ..... 2005-320044
Nov. 2, 2005 (JP) ..... 2005-320045

(51) Int. Cl.
*H04R 3/00* (2006.01)

(52) U.S. Cl. ..... 381/122; 381/58; 381/91; 381/92; 381/355

(58) Field of Classification Search ..... 381/122, 381/355, 91, 58, 92
See application file for complete search history.

(56) References Cited

U.S. PATENT DOCUMENTS

| | | | |
|---|---|---|---|
| 5,657,393 | A | 8/1997 | Crow |
| 5,848,170 | A | 12/1998 | Mahieux et al. |
| 6,084,973 | A | 7/2000 | Green et al. |
| 6,148,089 | A | 11/2000 | Akino |
| 6,494,363 | B1 | 12/2002 | Roger et al. |
| 6,868,045 | B1 | 3/2005 | Schröder |
| 2003/0059061 | A1 | 3/2003 | Tsuji et al. |
| 2004/0041902 | A1 | 3/2004 | Washington |
| 2004/0246607 | A1 | 12/2004 | Watson et al. |
| 2005/0175190 | A1 | 8/2005 | Tashev et al. |
| 2005/0201582 | A1 | 9/2005 | Hughes et al. |

(Continued)

FOREIGN PATENT DOCUMENTS

CN 1290467 A 4/2001

(Continued)

OTHER PUBLICATIONS

Written opinion issued in corresponding application No. PCT/JP2006/305196, dated Jun. 23, 2006.

(Continued)

*Primary Examiner* — Long Tran
(74) *Attorney, Agent, or Firm* — Rossi, Kimms & McDowell LLP

(57) ABSTRACT

A voice signal transmitting/receiving apparatus includes: a device body; a speaker array arranged in the device body and including a plurality of arrayed speaker units; and a microphone array arranged in the device body and including a plurality of arrayed microphones. By thus integrating the speaker array and the microphone array, it is possible to improve the operability of a user, to acquaint the user relatively easily with the error in the set position and to make the device compact.

4 Claims, 8 Drawing Sheets

U.S. PATENT DOCUMENTS

| | | | | |
|---|---|---|---|---|
| 2006/0204022 | A1 | 9/2006 | Hooley et al. | |
| 2008/0260178 | A1 * | 10/2008 | Tanaka | 381/92 |

FOREIGN PATENT DOCUMENTS

| | | | |
|---|---|---|---|
| EP | 1117076 | A2 | 7/2001 |
| EP | 1453349 | A2 | 9/2004 |
| JP | 59-69800 | A | 4/1984 |
| JP | 59-180139 | A | 10/1984 |
| JP | 59-181969 | A1 | 10/1984 |
| JP | 2-86397 | A | 3/1990 |
| JP | 2-114799 | A | 4/1990 |
| JP | 03-136557 | A | 6/1991 |
| JP | 4-318798 | A | 11/1992 |
| JP | 5-91588 | A | 4/1993 |
| JP | 10-023121 | * | 1/1998 |
| JP | 2000-032584 | A | 1/2000 |
| JP | 2000-324233 | A | 11/2000 |
| JP | 2000-354290 | A | 12/2000 |
| JP | 3274470 | B2 | 2/2002 |
| JP | 2003-087887 | A | 3/2003 |
| JP | 2004-165775 | A | 6/2004 |
| JP | 2004-343700 | A | 12/2004 |
| WO | 03-037034 | A1 | 5/2003 |
| WO | 2004/075601 | A1 | 9/2004 |

OTHER PUBLICATIONS

International search report issued in corresponding application No. PCT/JP2006/305196, Jun. 23, 2006.

Office Action issued in corresponding European Patent Application No. 06715687.7 dated Mar. 31, 2011.

"One Body Real 5.1 Surround"; Digital Sound Projector, YSP-1 Catalogue, Yamaha Corporation; issued Dec. 2004; p. 4.

Decision of Refusal issued in corresponding Japanese Patent Application 2005-320044 dated Aug. 23, 2011. English translation provided.

Decision of Refusal issued in corresponding Japanese Patent Application 2005-320045 dated Aug. 23, 2011. English translation provided.

Notification of Reasons for Refusal issued in corresponding Japanese Patent Application 2005-320045 dated Apr. 20, 2011.

Notification of Reasons for Refusal issued in corresponding Japanese Patent Application 2005-320044 dated Apr. 20, 2011.

Extended European Search Report issued in corresponding European Patent Application No. 06822658.8 dated May 7, 2010. Submitted in related co-pending U.S. Appl. No. 12/108,593.

Chou, Thomas "Frequency-independent beamformer with low response error" 1995 International Conference on Acoustics, Speech and Signal Processing, IEEE, New York, NY, vol. 5, May 9, 1995, pp. 2995-2998. Cited in EESR issued in corresponding EP 06822658.8 dated May 7, 2010; See NPL cite No. 1. Submitted in related co-pending U.S. Appl. No. 12/108,593.

International search report issued in corresponding application No. PCT/JP2006/321729, mailed Feb. 20, 2007. Submitted in related co-pending U.S. Appl. No. 12/108,593.

Tanaka, Ryo. "Audio Signal Transmission/Reception Device and Microphone Apparatus Thereof," Specification and Drawings of related co-pending U.S. Appl. No. 12/108,593, filed Apr. 24, 2008. pp. 1-27.

Office Action issued in corresponding Chinese patent application No. 200680040868.8, issued on Aug. 17, 2011.

Office Action issued Dec. 6, 2011 for corresponding CN200680040868.8 (English translation provided).

* cited by examiner

VOICE SIGNAL TRANSMITTING/RECEIVING APPARATUS

This application is a U.S. National Phase Application of PCT International Application PCT/JP2006/305196 filed on Mar. 9, 2006 which is based on and claims priority from JP 2005-320044 filed on Nov. 2, 2005 and JP 2005-320045 filed Nov. 2, 2005, the contents of which is incorporated herein in its entirety by reference.

BACKGROUND ART

This invention relates to a voice signal transmitting/receiving apparatus for transmitting and receiving voice signals with a partner voice signal transmitting/receiving apparatus and, more particularly, to improvements in the arrangements of a speaker array and a microphone array.

In the related art, there has been known (as referred to Non-Patent Publication 1, for example) an audio device, which includes a speaker array having a plurality of speaker units arrayed therein. This audio device is enabled, by giving a delay time to audio signals to be inputted to the individual speaker units, to control the orienting direction and the orienting range of the voice beam to be outputted from the speaker array. As a result, the voice beam can be outputted within a narrow orienting range covering only the position of the user so that only the user can listen to the voice even in case others are in the sound field.

There has also been known an audio device equipped with a microphone array having a plurality of microphones arrayed therein. This audio device controls the delay times of signals collected by the individual microphones. Specifically, the audio device performs the delay control of the voice signals inputted to the individual microphones, so as to compensate the difference in the arrival times for the voices to arrive at the individual microphones from a specific orienting area.

The aforementioned audio device adds and synthesizes the individual signals after controlled in delay. By these addition and synthesization, the voices from a specific orienting area are amplified in phase so that the voices from others of the specific orienting area become out of phase so that they cancel each other. As a result, this audio device can specify and collect the voices coming from the specific orienting area. By setting that specific area as the position of the user, only the voice of the user can be specifically collected while the noises from other areas being left uncollected.

Non-Patent Publication 1

"Digital Sound Projector, YSP-1 Catalogue", Yamaha Corporation, issued in December, 2004, page 4.

DISCLOSURE OF THE INVENTION

When a voice signal transmitting/receiving apparatus is constituted to include an audio device (as will be called the first audio device) having the aforementioned speaker array of the related art and an audio device (as will be called the second audio device) having a microphone array, voice communications can be made handsfree. By orienting the voice beam and the sound collecting beam toward the position of the user, more specifically, it is possible to allow only the user to listen to the voice from the partner, and to transmit the voice specialized to that of the user, to the partner. However, the present voice signal transmitting/receiving apparatus has the following disadvantages.

In order to orient the voice beam and the sound collecting beam to the position of the user, it is necessary to input the position of the user to the first audio device and the second audio device. The construction for the user to input the position by means of an operation unit has to make individual settings for the first and second audio devices thereby to deteriorate the operability.

In case the first and second audio devices have functions to automatically detect the user position, these operations are individually performed by the first and second audio devices. This may make different the detection positions of the first and second audio devices.

In case the first audio device makes an erroneous detection in the position, the user can be easily acquainted with the erroneous detection because the user cannot listen to the voice. However, in case the erroneous detection occurs in the detection position at the second audio device, the collected voice is transmitted to the partner voice signal transmitting/receiving apparatus and is released from the partner voice signal transmitting/receiving apparatus so that the user hardly notices the erroneous detection.

Moreover, the first and second audio devices are made separate and are individually equipped with the construction which are used in both of the first and second audio devices so that the voice signal transmitting/receiving apparatus can hardly be made compact.

Moreover, the arrangement having the speakers and the microphones in different devices are made different in the roundabout of the voices from the speakers to the microphones in dependence upon the setting states. As a result, it is difficult to standardize the echo cancellations of the voices to go round from the speakers to the microphones.

In order to solve the aforementioned problems, it is an object of the invention to provide a voice signal transmitting/receiving apparatus, which can give the user an excellent operability, which can acquaint the user relatively easily with the error in the set position and which can perform the echo cancellation efficiently with a compact construction.

In order to solve the aforementioned problems, the invention adopts the following arrangement.

(1) A voice signal transmitting/receiving apparatus comprising:

a device body;

a speaker array that is arranged in the device body and includes a plurality of arrayed speaker units; and a microphone array that is arranged in the device body and includes a plurality of arrayed microphones.

According to the aforementioned construction, the common device body has the speaker array and the microphone array. In case the user inputs the orienting position, the single operation may be sufficient for the same orienting position of the voice beam and the sound collection beam. In case the position of the user is automatically detected to direct the voice beam and the sound collection beam toward the detection position, on the other hand, the orienting position of the sound collection beam becomes identical to that of the voice beam.

As compared with related art, in which the device having the microphone array and the device having the speaker array are different to detect the user position individually, therefore, an erroneous detection, if any, of the position of the user, to which the sound collection beam is directed, can be relatively easily recognized by the user. Unlike the related art, specifically, there is no possibility of difference between the user position for directing the voice beam and the user position for directing the sound collection beam. Therefore, the voice beam from the speaker array cannot be listened to so that the user can be made to recognize that the error detection has occurred in the positions of the two users.

Moreover, the device body is constituted to include the speaker array and the microphone array so that it can be commonly used. Therefore, the voice signal transmitting/receiving apparatus can be made compact.

Moreover, the speakers and the microphones are arranged in the common device body so that the roundabout of the voices from the speakers to the microphones is not seriously changed irrespective of the manner how to mount the device body by the user. Therefore, it is possible to standardize the echo canceling operation of the voices, which might otherwise go round from the speakers to the microphones. As a result, it is possible to perform the echo cancellation efficiently.

(2) A voice signal transmitting/receiving apparatus according to (1), wherein the speaker array and the microphone array are arranged so that the array direction of the speaker units and the array direction of the microphones are in parallel to each other and a sound collecting face of the microphone array and a sound releasing face of the speaker array forms substantially a right angle.

According to the aforementioned construction, the sound collecting face and the sound releasing face are arranged at a right angle so that microphone array can be arranged in the direction toward the lower sound pressure of the voices from the speaker array. This arrangement can efficiently suppress the acoustic coupling, in which the voices from the speaker array might otherwise be inputted to the microphone array.

In case the microphones of a single directivity prevented from collecting the voices from the back are used in the microphone array, the voices from the speaker array can be prevented from being collected by the microphone array thereby to prevent the acoustic coupling more efficiently.

(3) A voice signal transmitting/receiving apparatus according to (2), wherein the speaker array is arranged toward the lower face or the upper face of the device body; and a pair of the microphone arrays are individually arranged on a pair of side faces substantially perpendicular to the array direction of the speaker units.

According to the aforementioned construction, the sound releasing direction of the speaker array and the sound collecting direction of the microphone arrays can be arranged perpendicularly of each other thereby to prevent the aforementioned acoustic coupling efficiently.

Moreover, a portion of the microphone arrays is arranged toward one of the side faces of the device body at a right angle of the array direction of the speaker units whereas the remaining portion is arranged toward the other side face. As a result, the voice having gone round from the speaker array to the microphone arrays can be efficiently canceled by the signal processing. Specifically, the plural microphone arrays and the speaker array are arrayed, as described above, the distances between the speaker array and the microphone arrays arranged on the two sides can be substantially equalized.

As a result, the voices to go round the microphone arrays on the two sides are substantially identical. In case the user is located only on the side of one microphone array, the voice signal collected by the microphone array is cleared of the voice signal collected by the microphone array on the other side, so that the voice signal having gone round the speaker array can be efficiently canceled.

(4) A voice signal transmitting/receiving apparatus according to (1), wherein the array direction of the speaker units and the array direction of the microphones are in parallel to each other; and the microphone array and the speaker array are so arrayed toward a common flat plane side of the device body that a sound collecting direction of the microphone array and a sound releasing direction of the speaker array are parallel to each other.

According to the aforementioned construction, the sound collecting directions of the microphone arrays and the sound releasing direction of the speaker array are parallel to each other. In case the orienting areas of the sound collecting beam and the sound beam are made identical, the mounting direction of the device body can be easily adjusted to orient both the sound collecting beam and the sound beam efficiently to the orienting area.

(5) A voice signal transmitting/receiving apparatus according to (4), wherein at least two of the microphone arrays are arranged; and the microphone arrays are individually arranged at positions apart from the two sides of the speaker units by substantially equal distance.

According to this construction, the distances between the speaker array and the microphone arrays arranged on the two sides are substantial equal so that the voices to go round to the microphone arrays on the two sides become substantially identical. In case the user is located only on the side of one microphone array, the voice signal collected by the microphone array is cleared of the voice signal collected by the microphone array on the other side, so that the voice signal having gone round the speaker array can be efficiently canceled.

(6) A voice signal transmitting/receiving apparatus according to (1), wherein the microphones have a single directivity.

(7) A voice signal transmitting/receiving apparatus according to (1), wherein the device body includes an orienting direction informing unit for indicating either an orienting direction of a sound releasing direction of the speaker array or an orienting direction of a sound collecting direction of the microphone array.

(8) A voice signal transmitting/receiving apparatus comprising:

a device body;

a sound releasing unit arranged in the device body; and a microphone array having a plurality of microphones of a single directivity arrayed.

According to the aforementioned construction, the sound can be collected by forming the sound collecting beam which has been specified to a specific sound collecting area by the microphone array.

Moreover, the individual microphones composing the microphone array are microphones of a single directivity. By disposing the sound releasing unit is disposed in the direction of the lower sensitivity of the microphone array, it is possible to efficiently prevent the voices from the sound releasing unit from being collected by the microphone array.

(9) A voice signal transmitting/receiving apparatus according to (8), wherein the sound releasing unit is disposed in the direction to the lower sensitivity of the microphone array.

(10) A voice signal transmitting/receiving apparatus according to (8) or (9), wherein the sound releasing unit is a speaker array having a plurality of arrayed speaker units;

an array direction of the microphones and an array direction of the speaker units are parallel to each other; and the microphone array and the speaker array are so arranged in the device body that a sound collecting face of the microphone array and a sound releasing face of the speaker array are perpendicular to each other and the sound collecting direction and the sound releasing direction are directed outwardly.

According to the aforementioned construction, the sound collecting face and the sound releasing face are arranged at a right angle so that the speaker array can be arranged in the direction toward the lowest sensitivity of the microphones of the single directivity and so that the microphone array can be arranged at the positions of the lowest source pressure of the voices from the speaker array. As a result, it is possible to prevent more efficiently the acoustic coupling, in which the voices from the speaker array might otherwise be inputted to the microphone array.

(11) A voice signal transmitting/receiving apparatus of any of (8) to (10), wherein the device body includes a frame for mounting the microphone array; and a plurality of small holes are formed in the frame in the periphery of the mounting positions of the individual microphones.

In order to effectively cancel the roundabout sound from the direction other than from the orienting direction with the single directivity microphones, it is ideal to arrange the microphones in a sound field which were as if floating in the air. In the invention, however, the influences of the acoustic resistance by the frame are effectively prevented by forming the small holes thereby to come closer to the ideal state. Therefore, the roundabout voices from a direction other than the orienting direction are more efficiently canceled in the individual microphones. Because of the small holes, moreover, the roundabout sounds can be canceled while retaining the strength of the frame.

(12) A voice signal transmitting/receiving apparatus according to (11), wherein the frame is a member having a substantially C-shape and prepared by bending an elongated, flat sheet upward substantially at a right angle on at least one edge in a transverse direction thereof, the speaker array is so attached to the upper face of the frame that a sound releasing direction of the sound releasing unit is directed toward the frame, holes are formed at the positions of the speaker units, the microphone array is so buried in the bent edge of the frame over the longitudinal direction that the sound collecting side is directed to the outer side, and the small holes are formed in an end portion of the upper face of the frame on the side of the microphone array and in an edge of the frame where the microphone array is arranged.

According to the aforementioned construction, the sound releasing direction of the speaker array and the sound collecting direction of the microphone array can be arranged at a right angle, so that the speaker array can be arranged in the direction of the lower sensitivity of the microphone array.

Moreover, it is possible to prevent the influences of the acoustic resistance due to the frame more efficiently with the small holes in the upper face of the frame and the small holes in the edge of the frame, and to cancel the roundabout sound from the direction other than the orienting direction more efficiently in the individual microphones.

(13) A voice signal transmitting/receiving apparatus according to (12), wherein the frame is supported at a predetermined level from the mounting face by substantially rectangular leg units disposed on two sides of the frame.

(14) A voice signal transmitting/receiving apparatus according to (11), wherein the small holes are formed at such positions that voices from the speaker array transmit in a lowest sensitivity direction from the microphone array.

According to this construction, the voices from the speaker array propagate in the direction from the microphone array of the lowest sensitivity to the microphones. It is, therefore, possible to make less the influences of the frame, which might otherwise be exerted on the microphones of the single directivity by the small holes, to efficiently prevent the voices coming from the speaker array through the small holes from being collected by the microphones.

According to the invention, the common device body has the speaker array and the microphone array. In case the user inputs the orienting position, therefore, the single operation may be sufficient for the same orienting position of the voice beam and the sound collection beam.

Unlike the related art, moreover, there is no probability that the user position, to which the voice beam is oriented, and the user position, to which the sound collecting is oriented, are different. Therefore, the user can recognize that an erroneous detection has occurred on the two user positions, because the sound beam from the speaker array cannot be listened to. Moreover, the common construction of the speaker array and the microphone arrays can be shared to become compact.

As has been described hereinbefore, it is possible to provide a voice signal transmitting/receiving apparatus, which can give the user an excellent operability, which can acquaint the user relatively easily with the error in the set position and which can perform the echo cancellation efficiently with a compact construction.

Moreover, the speakers and the microphones are arranged in the common device body so that the roundabout of the voices from the speakers to the microphones is made identical in the positional relation. Irrespective of the manner how to mount the device body 2 by the user, therefore, it is possible to standardize the echo canceling operation of the voices, which might otherwise go round from the speakers to the microphones. As a result, it is possible to perform the echo cancellation efficiently.

By removing the sound releasing unit from the sound collecting area and by disposing the sound releasing unit in the lower direction of the sensitivity of the microphones of the single directivity, according to the invention, it is possible to efficiently prevent the roundabout of the voices from the sound releasing unit. Although the sound releasing unit and the microphone array are arranged closer to each other, therefore, it is possible to efficiently prevent the howling from being caused by the voices having gone around to the microphone array.

BEST MODE FOR CARRYING OUT THE INVENTION (First Embodiment)

A voice signal transmitting/receiving apparatus 1 according to a first embodiment of the invention is described in detail in the following with reference to FIG. 1 to FIG. 7. The voice signal transmitting/receiving apparatus 1 is connected with a network such as an internet or LAN. The voice signal transmitting/receiving apparatus 1 transmits and receives voice signals with a partner voice signal transmitting/receiving apparatus 1 through the network thereby to give users an audio teleconference with a partner audio conference device 1.

Figure 1:
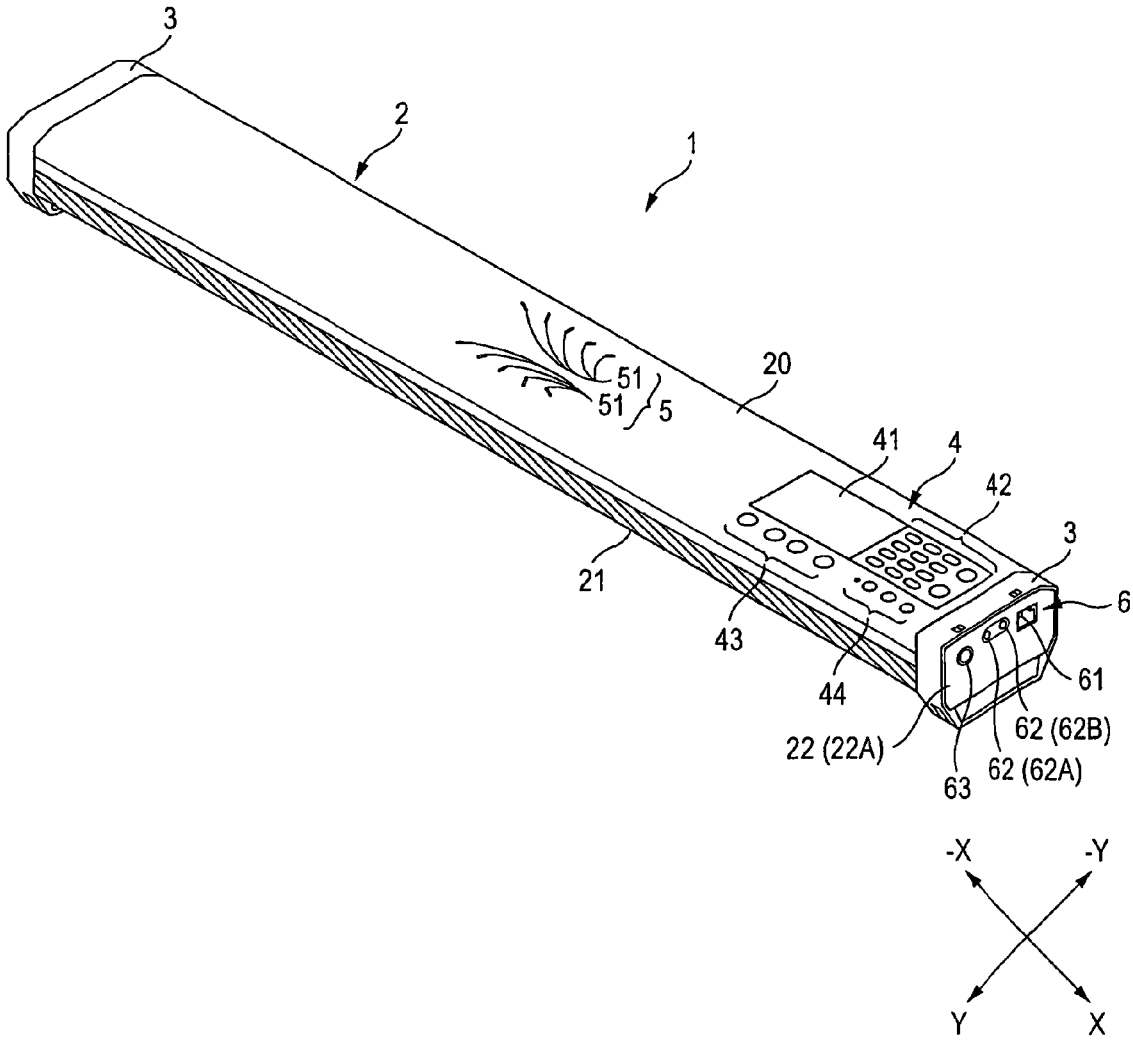
FIG. 1 is a perspective view showing the exterior of a voice signal transmitting/receiving apparatus.
Figure 2A:
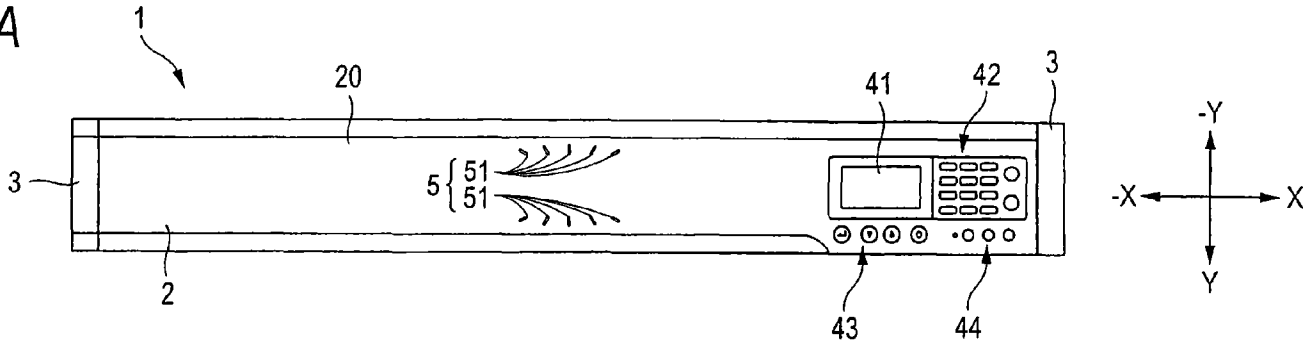
FIG. 2A is a top plan view of the voice signal transmitting/receiving apparatus shown in FIG. 1.
Figure 2B:
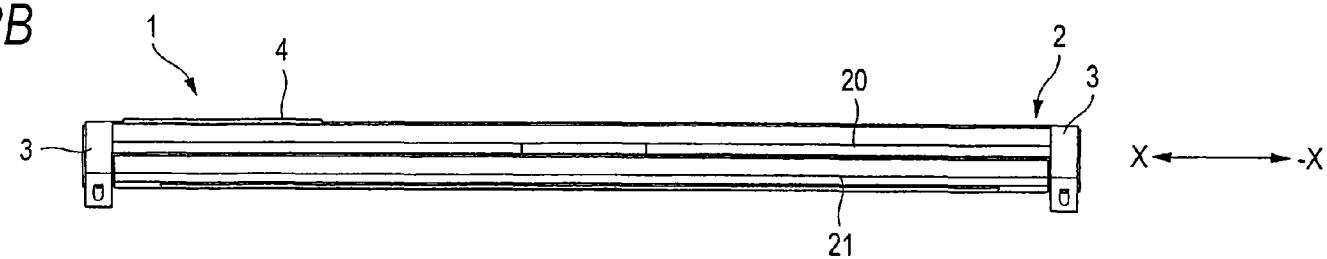
FIG. 2B is a back side view of the voice signal transmitting/receiving apparatus and is taken from a −Y-side.
Figure 2C:
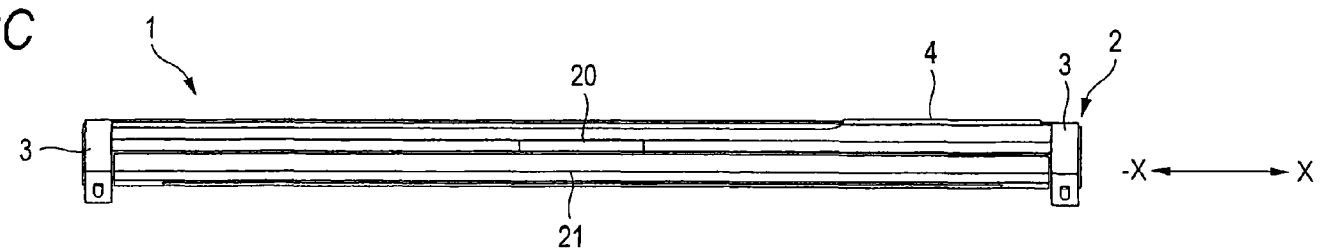
FIG. 2C is a front elevation of the voice signal transmitting/receiving apparatus and is taken from a Y-side.
Figure 3A:
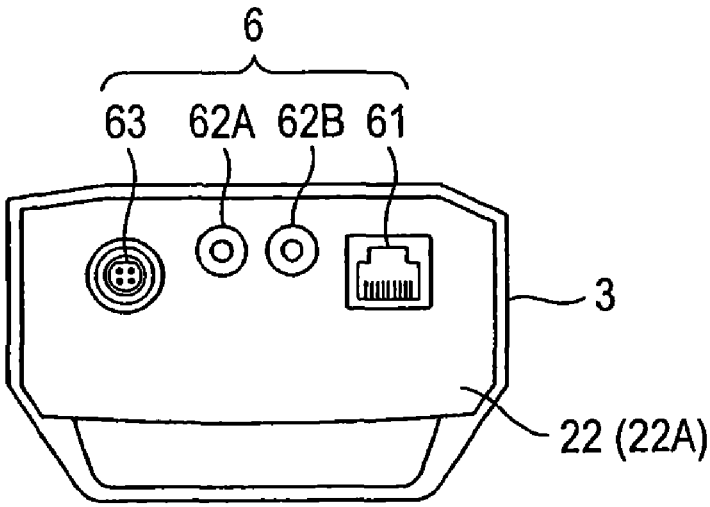
FIG. 3A is a right side elevation of the voice signal transmitting/receiving apparatus and is taken from an X-side.
Figure 3B:
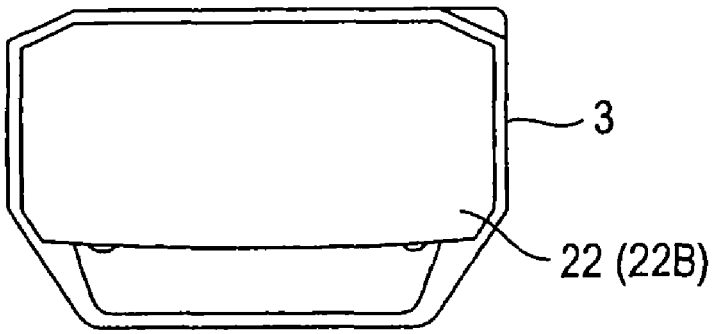
FIG. 3B is a left side elevation of the voice signal transmitting/receiving apparatus and is taken from a −X-side.

FIG. 1 is a perspective view showing the exterior of the voice signal transmitting/receiving apparatus 1. In the following description, the front side, the back side, the right side and the left side of the voice signal transmitting/receiving apparatus 1 are designated by Y, −Y, X and −X, respectively. FIG. 2A is a top plan view of the voice signal transmitting/receiving apparatus 1 shown in FIG. 1; FIG. 2B is a back side view of the voice signal transmitting/receiving apparatus 1 and is taken from a −Y-side; and FIG. 2C is a front elevation of the voice signal transmitting/receiving apparatus 1 and is taken from a Y-side. FIG. 3A is a right side elevation of the voice signal transmitting/receiving apparatus 1 and is taken from an X-side; and FIG. 3B is a left side elevation of the voice signal transmitting/receiving apparatus 1 and is taken from a −X-side.

The voice signal transmitting/receiving. apparatus 1 is constituted such that a device body 2 having an elongated, substantially rectangular parallelepiped shape is supported at a predetermined level from an installation face by substantially rectangular leg units 3 fitted to the two sides of the device body 2. The device body 2 has an upper face panel 20, a lower face grille 21 and side panels 22 (22A and 22B), which form a casing. The voice signal transmitting/receiving apparatus 1 is equipped in the casing with an elongated speaker device 23 (as will be described with reference to FIG. 5) having a speaker array 231 (as will be described with reference to FIG. 4), and two rows of microphone arrays 24 (24A, 24B, as will be detailed with reference to FIG. 5).

The speaker array 231 is disposed in one row in the longitudinal direction on the lower face of the speaker device 23, and the microphone arrays 24 are disposed in one row on each of the two sides in the longitudinal direction of the speaker device 23. Here, the structures of the speaker device 23, the speaker array 231 and the microphone arrays 24 will be described hereinafter in detail.

The upper panel 20 and the side panels 22 are resin panels as the covers of the internal structure including the speaker array 231 and the microphone arrays 24. The upper panel 20 is an elongated member having a U-shaped section, and the side panels 22 are members of a flat plate shape. On the other hand, the lower face grille 21 is made of a punching steel sheet having a substantially U-shaped section so as not to obstruct the release and collection of sounds of the speaker array 231 and the microphone arrays 24.

An operation unit 4 is buried in the X-side end portion of the upper face of the upper face panel 20, and an LED light unit 5 is buried in a generally central portion. The operation unit 4 is so equipped with an LCD (Liquid Crystal Display) 41 for displaying setting states and so on and an operation button group 42 for communications such as ten keys. The LCD 41 and the operation button group 42 are juxtaposed relatively on the −X-side and the X-side, respectively.

Moreover, the operation unit 4 is equipped with an operation button group 43 and an operation button group 44, which are juxtaposed to each other on the Y-side of the LCD 41 and the operation button group 42. The operation button group 43 is so arranged on the −X-side of the operation button group 44 as to instruct the up/down and mute of the volume. The operation button group 44 is provided for changing the setting of the present voice signal transmitting/receiving apparatus 1. This setting is exemplified by selecting one of a first lighting mode and a second lighting mode, as will be described hereinafter.

Here, all the LCD 41 and the operation button groups 42 to 44 are arranged with the Y-side down so that they can be operated and confirmed in the operations from the Y-side.

The LED light unit 5 is equipped with a plurality of (e.g., individually five in this embodiment) linear LED lamps 51 on the −Y-side and on the Y-side. The plural LED lamps 51 are arranged on the common parabola extending in the X-X direction. The lightings of the individual LED lamps 51 are independently controlled by the not-shown light control unit which is attached to the inner side of the upper face panel 20. Of the individual LED lamps 51, specifically, control is made to light the lamp indicating the orienting direction of the voice beam from the speaker array 231 described later, in case the first lighting mode is set by the operation button group 44. As a result, the user can confirm the orienting direction of the voice beam.

In case the second lighting mode is set, on the other hand, control is made to light the orienting direction of the sound collection beam of the later-described microphone arrays 24. Here, the LED lamps 51 on the Y-side are lit for the Y-side microphone arrays 24, and the LED lamps 51 on the −Y-side are lit for the −Y-side microphone arrays 24. This makes it possible to confirm whether or not a voice is inputted and to confirm the orienting direction of the sound collection beam.

In this embodiment, the voice signal transmitting/receiving apparatus 1 is provided, in a plurality of areas, with the functions to control the sound collection beam and to detect the position of a speaker on the basis of the sound collection levels in the individual areas. In the second lighting mode, therefore, the user can confirm whether or not the position of the speaker is erroneously detected.

On the other hand, control is made to change the lighting mode according to the volume of voices inputted/outputted. As a result, the user can confirm whether or not the input/output of the voices are being performed in a sufficient volume.

In the X-side side panel 22 (22A), there is buried a connector group 6 (as referred to FIG. 3A) for the external device. The connector group 6 is constituted to include a modular jack 61 for connections with a LAN such as Ethernet (Registered Trade Mark) or a network such as an internet, an audio input terminal 62A and an audio output terminal for connections with an audio equipment, and a power source terminal 63 for connections with a power source.

The voice signal transmitting/receiving apparatus 1 can be connected with the network by inserting the (not-shown) plug of a modular cable into the modular jack 61. As a result, the present voice signal transmitting/receiving apparatus 1 can be connected with the network thereby to communicate with the partner voice signal transmitting/receiving apparatus 1. As a result, talks and audio teleconferences can be done with the partner voice signal transmitting/receiving apparatus 1 so that the present voice signal transmitting/receiving apparatus 1 can be used as an IP telephone or an audio teleconference equipment.

Figure 4:
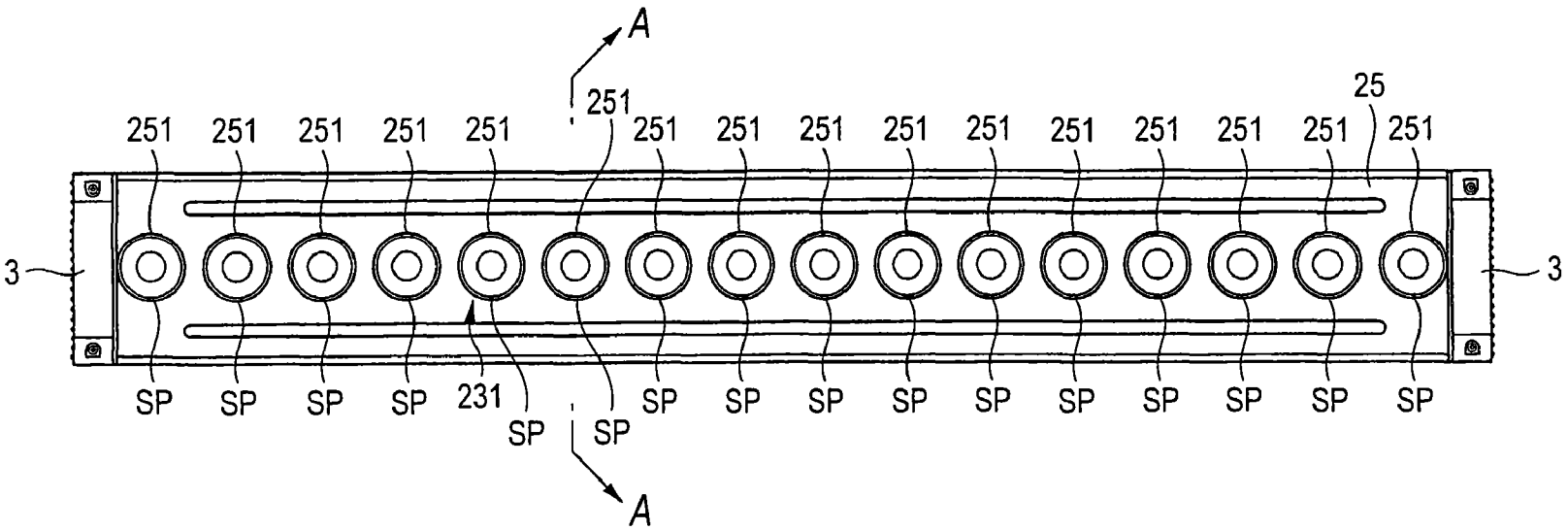
FIG. 4 is a bottom view of the state, in which a grille is removed from the voice signal transmitting/receiving apparatus.
Figure 5:
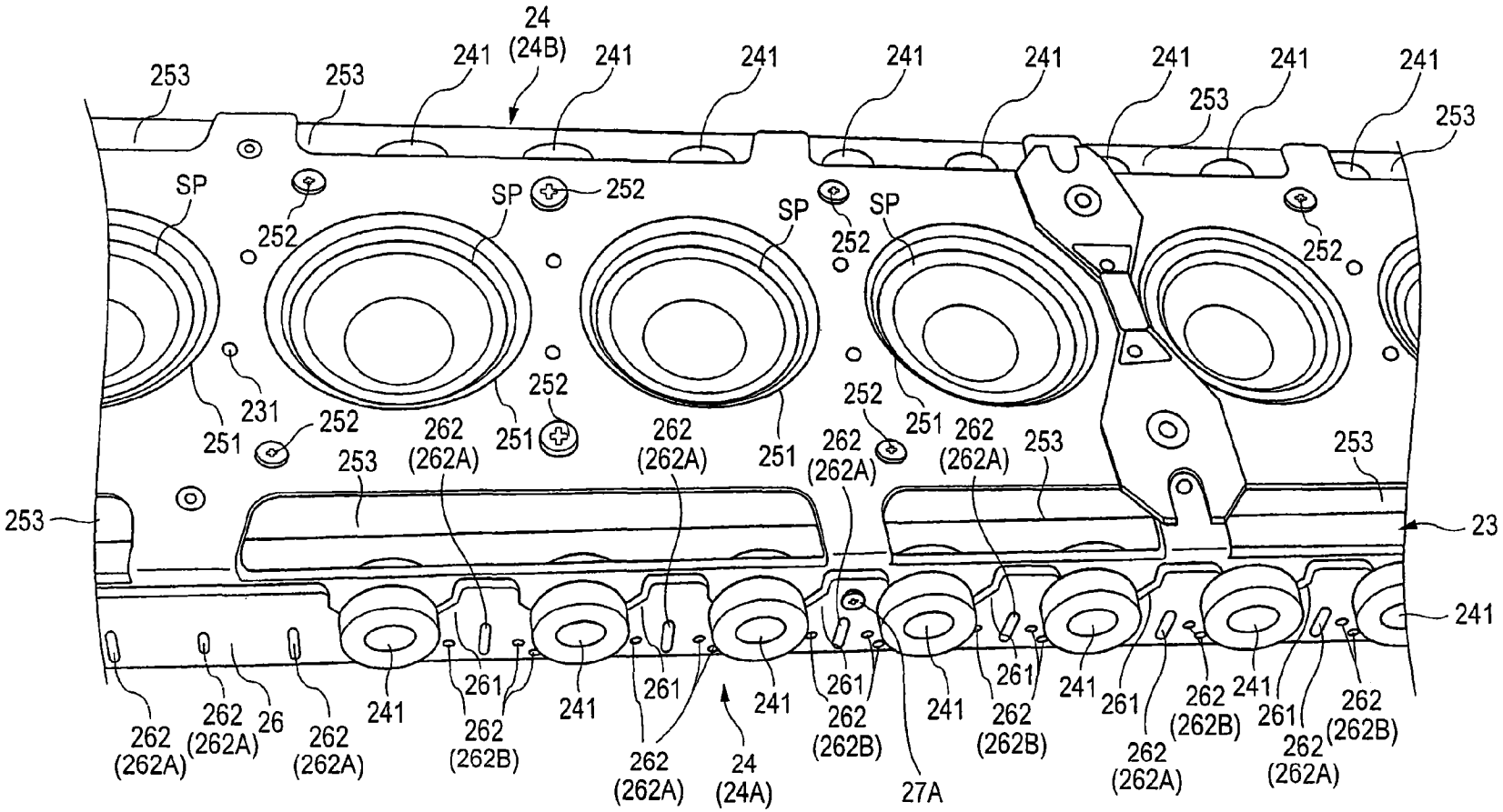
FIG. 5 is a perspective view of a central portion of the voice signal transmitting/receiving apparatus of FIG. 4.
Figure 6:
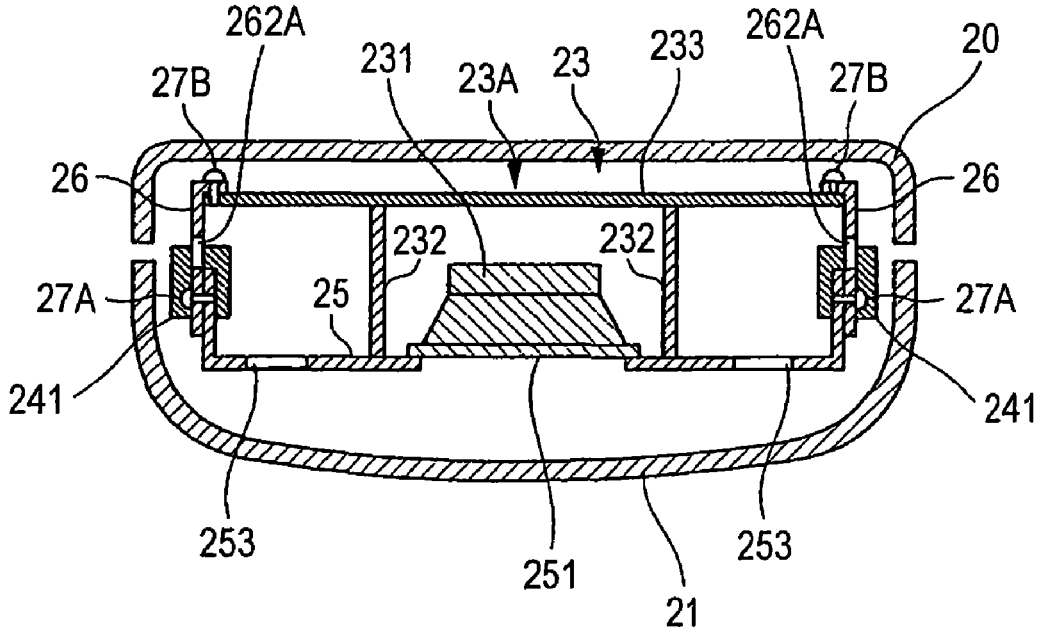
FIG. 6 is a section A-A of the voice signal transmitting/receiving apparatus of FIG. 4.
Figure 7:
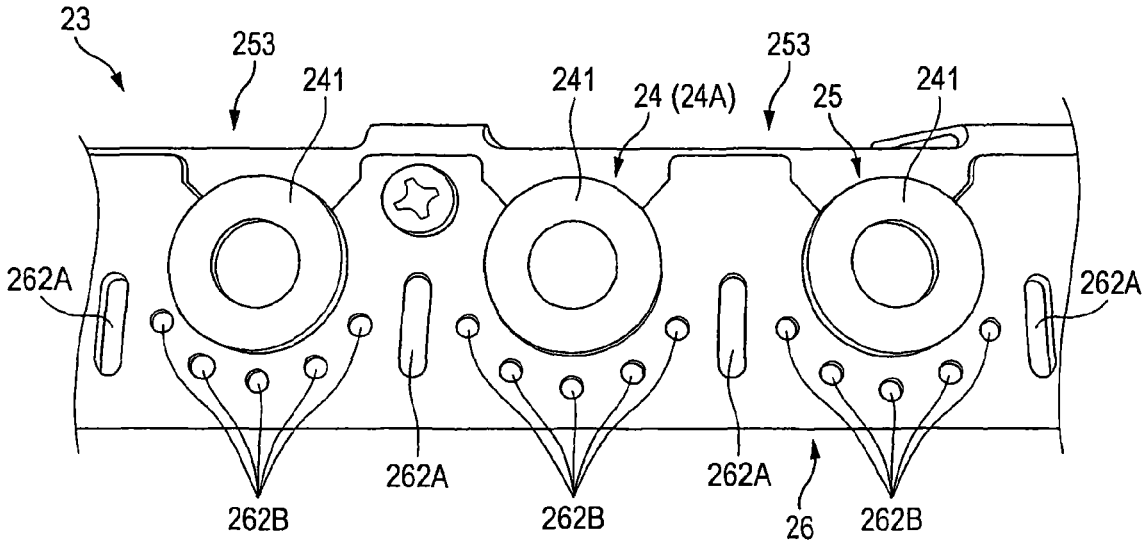
FIG. 7 is a front elevation of a central portion of the voice signal transmitting/receiving apparatus of FIG. 4.

FIG. 4 is a bottom view of the state in which the lower face grille 21 is removed from the voice signal transmitting/receiving apparatus 1; FIG. 5 is a perspective view of a central portion of the voice signal transmitting/receiving apparatus 1 of FIG. 4; FIG. 6 is a section A-A of the voice signal transmitting/receiving apparatus 1 of FIG. 4; and FIG. 7 is a front elevation of a central portion of the voice signal transmitting/receiving apparatus 1 of FIG. 4.

Both the speaker array 231 and the microphone arrays 24 are mounted in a frame 25 acting as the baffle for the speaker array 231. The frame 25 is a box-shaped member, which is prepared by folding up the four corners of a rectangular metal sheet. The speaker array 231 is mounted downward on the inner side of the bottom face of the frame 25. Of the microphone arrays 24, one row (i.e., the microphone array 24A) is buried in one side face (i.e., the Y-side side face), and the other row (i.e., the microphone array 24B) is buried in the other side face (i.e., the −Y-side side face).

On the upper side of the frame 25, on the other hand, there is so arranged the lower end of an elongated, cylindrical frame member 232 (i.e., the side plates of the invention) as to cover the side faces of the speaker array 231. This frame member 232 is fastened at its two side faces (i.e., transverse side faces) to the side faces (i.e., the transverse bent portions) of the frame 25 by means of screws. Thus, the frame 25 is formed into a box shape, and the frame member 232 is fastened at its transverse bent portions by the screws so that the frame member 232 and the frame 25 can be firmly fastened to each other.

At the upper end of the frame member 232, there is so arranged a top plate 233 having a size substantially equal to that of the bottom face of the frame 25 as to cover the back face of the speaker array 231. Support plates 26 or metallic plate members are attached to extend upward to the side faces (i.e., the longitudinal bent portions) of the frame 25 by means of screws 27A, and are bent inward at their upper ends. These bent portions and the transverse end portions of the top plate 233 are attached to each other by means of screws 27B, so that the frame member 232 is clamped between the top plate 233 and the bottom face of the frame 25.

As thus described, a casing 23A of the speaker array 231 is defined by the frame 25, the top plate 233 and the cylindrical frame member 232. To the upper face of the casing 23A (i.e., the upper face of the top plate 233), there is attached the (not shown) board, on which the (not-shown) control unit is mounted for controlling the directivities of the speaker array 231 and the microphone arrays 24. The speaker device 23 is constituted to include the control unit, the casing 23A and the speaker array 231.

The speaker array 231 is made by arraying a plurality of (e.g., 16) speaker units SP at substantially even intervals in a line shape. In the bottom face of the frame 25, there are formed holes 251 which are located at the positions of the individual speaker units SP to have the same size as the internal diameter of the speaker units SP. The portions of the speaker units SP on the sound releasing side are registered with those holes 251. Thus, the bottom face of the frame 25 and the speaker array 231 are so attached by means of screws 252 that the speaker units SP are registered with the holes 251. As a result, the speaker units SP are attached to have their sound releasing faces exposed from the bottom face so that their individual voices can be outputted from that bottom base.

The speaker array 231 is arranged toward the bottom face of the voice signal transmitting/receiving apparatus 1 so that the voice beam from the speaker array 231 is outputted downward of the voice signal transmitting/receiving apparatus 1. This voice signal transmitting/receiving apparatus 1 is supported at a predetermined level from the mounting face (e.g., the top plate of a disk) by the leg units 3 so that the voice beam is so reflected on the mounting face as to transmit obliquely upward. As a result, the voice signal transmitting/receiving apparatus 1 can provide the voice beam efficiently for the user, whose head is located above the Y-Y side of the voice signal transmitting/receiving apparatus 1.

Moreover, the leg units 3 have a hollow structure so that the voice can be provided for the user without obstructing the released sound by the speaker array 231 and the reflected sound from the mounting face.

The (not-shown) control unit applies a delay time to the voice signals, which are inputted through the modular jack 61 (as referred to FIG. 1) from the partner voice signal transmitting/receiving apparatus 1, thereby to control the directivity of the voice beam, subjects the voice signals received from the partner to a D/A conversion or amplifies the level of the converted voice signals, and inputs the voice signals to the speaker array 231.

The microphone arrays 24 are composed of a plurality of (e.g., 16) microphones 241, which are arrayed in lines over the two side faces (i.e., on the longitudinal bent portions) of the frame 25, as described hereinbefore. The individual microphones 241 are so heterogeneously arrayed as to become denser to the inner side so that they can properly collect the highly directive voices of a high-pitched tone.

The microphone arrays 24 are supported from the opposite sides of the frame 25 by the support plates 26 having cut-away portions 261 formed at the positions of the microphone 241. The frame 25 and the support plates 26 are so fastened to each other by means of screws that the microphones 241 are fitted in those cut-away portions 261. Here, the frame 25 and the support plates 26 constitute the frame member of the invention.

As has been described hereinbefore, the speaker array 231 is arranged toward the bottom face of the speaker device 23, and the microphone arrays 24A and 24B are attached toward the individual side faces of the speaker device 23 (i.e., toward the individual side faces of the voice signal transmitting/receiving apparatus 1) so that the sound collecting faces of the microphone arrays 24 and the sound releasing face of the speaker array 231 can be arranged to make a right angle. At the same time, the microphone arrays 24 and the speaker array 231 can also be arranged to orient the sound releasing direction and the sound collecting directions outward of each other.

Since the microphone arrays 24 is specialized for the specific sound collection area by the sound collection beam by arranging the microphone arrays 24 and the speaker array 231 in those positional relations, the voices from the speaker array 231 can be made hard to round about. Moreover, the microphone arrays 24 can be arranged at the positions where the voices from the speaker array 231 have the lowest sound pressure. With this arrangement, it is also possible to efficiently prevent the roundabout of the voices from the speaker array 231 to the microphone arrays 24.

The individual microphones 241 are single-directivity microphones, in which the (not-shown) holes are formed in the side face positions at the back of the (not-shown) diaphragm to input the voices from the back through those holes thereby to cancel the voices coming to the microphone arrays 24 from the back. The sound collection is made by the microphone arrays 24 composed of the microphones 241 of the single directivity, as has been described hereinbefore, so that the roundabout from the speaker array 231 can be efficiently prevented to prevent the echoes efficiently.

Moreover, the sound collecting faces of the microphone arrays 24 and the sound releasing faces of the speaker array 231 are arranged at a right angle, so that the speaker array 231 can be arranged in the direction of a low sensitivity (or gain) of the microphones 241. This arrangement can efficiently suppress the acoustic coupling, in which the voices from the speaker array 231 might otherwise go round to the microphone arrays 24. This construction also arranges the microphone arrays 24 in the direction of low directivity of the speaker array 231. As a result, it is efficiently possible to further suppress the acoustic coupling, in which the voices from the speaker array 231 might otherwise go round to the microphone arrays 24.

Moreover, the microphone arrays 24A is arranged to face the Y-side side face perpendicular to the array direction of the speaker units of the side face of the device body, and the microphone arrays 24B is arranged to face the −Y-side side face, and the distances between the speaker array 231 and the microphone arrays 24A and 24B are substantially equal. As a result, the voices to go round to the microphone arrays 24A and 24B also become substantially equal. In case the user is located on only one of the −Y-side and the Y-side, the not-shown control unit of the voice signal transmitting/receiving apparatus 1 eliminates the voice signals collected by the microphone array 24 on the other side, from the voice signals collected by the microphone arrays 24, so that the control unit can efficiently cancel the voice signals having gone round from the speaker array 231.

The individual microphones 241 are microphones of the single directivity, which are so attached to the frame 25 that the (not-shown) holes are located on the inner side of the frame 25. At the same time, holes 253 are formed in the bottom face of the frame 25 at the back positions of the individual microphones 241 so as to cancel the roundabout voices coming from the back. In the support plates 26, moreover, five circular holes 262B are formed in the support plates 26 round the individual microphones 241, and slots 262A are formed between the individual microphones 241. The holes 253, the slots 262A and the circular holes 262B are made so small as to retain the strengths of the frame 25 and the support plates 26.

With the holes 253, 262A and 262B thus formed, it is possible to prevent the microphones 241 from being disabled by the acoustic resistances of the frame 25 and the support plates 26 to efficiently cancel the voices in a direction other than that of the directivity. On the other hand, the holes 253, 262A and 262B are formed at such positions that the voices from the speaker array 231 may reach the microphones 241 in the directions of the microphones 241 of the lowest sensitivity. As a result, the voices from the speaker array 231 can be efficiently prevented from being collected by the microphones 241, while efficiently preventing the influences of the acoustic resistances of the frame 25 and the support plates 26 by the holes 253, 262A and 262B.

The microphone arrays 24 is connected with the (not-shown) control unit by the not-shown signal lines so that the individual signals collected by the individual microphones 241 are inputted to the control unit. These individual signals thus inputted are A/D converted and then controlled in directivity by the delay control, and are transmitted to the partner voice signal transmitting/receiving apparatus 1 through the modular jack 61 (as referred to FIG. 1), the not-shown modular cable and so on.

In this embodiment, as described hereinbefore, the microphone arrays 24 collects the sounds with the sound collection beam so that the roundabout of the voices from the speaker array 231 can be efficiently prevented. Moreover, the individual microphones 241 are the single-directive microphones, and the microphone arrays 24 is disposed in the direction of the low directivity, so that the roundabout from the speaker array 231 can be more efficiently prevented. As a result, the occurrence of echoes can be efficiently prevented while the voice signal transmitting/receiving apparatus 1 being made compact by arranging the speaker array 231 and the microphone arrays 24 close to each other.

In this embodiment, as described hereinbefore, in case the user inputs the orienting position by arranging the speaker array 231 and the microphone arrays 24 in the common voice signal transmitting/receiving apparatus 1, the single operation may be sufficient for the same orienting position of the voice beam and the sound collection beam, so that the operability can be improved.

In case the position of the user is automatically detected to direct the voice beam and the sound collection beam toward the detection position, on the other hand, the orienting position of the sound collection beam becomes identical to that of the voice beam.

As compared with related art, in which the device having the microphone arrays 24 and the device having the speaker array are different to detect the user position individually, an erroneous detection, if any, of the position of the user, to which the sound collection beam is directed, can be relatively easily recognized by the user. Unlike the related art, specifically, there is no possibility of difference between the user position for directing the voice beam and the user position for directing the sound collection beam. Therefore, the user can be made to recognize that the error detection has occurred in the positions of the two users by the fact that the voice beam from the speaker array 231 cannot be listened to.

Moreover, the device body 2 is constituted to include the speaker array 24 and the microphone arrays 231 so that it can be commonly used. Therefore, the voice signal transmitting/receiving apparatus 1 can be made compact.

Moreover, the speaker array 231 and the microphone arrays 24 are arranged in the common device body 2 so that the roundabout of the voices from the speaker array 231 to the microphone arrays 24 is not seriously changed irrespective of the manner how to mount the device body 2 by the user. Therefore, it is possible to standardize the echo canceling operation of the voices, which might otherwise go round from the speaker array 231 to the microphone arrays 24. As a result, it is possible to perform the echo cancellation efficiently.

(Second Embodiment)

Figure 8:
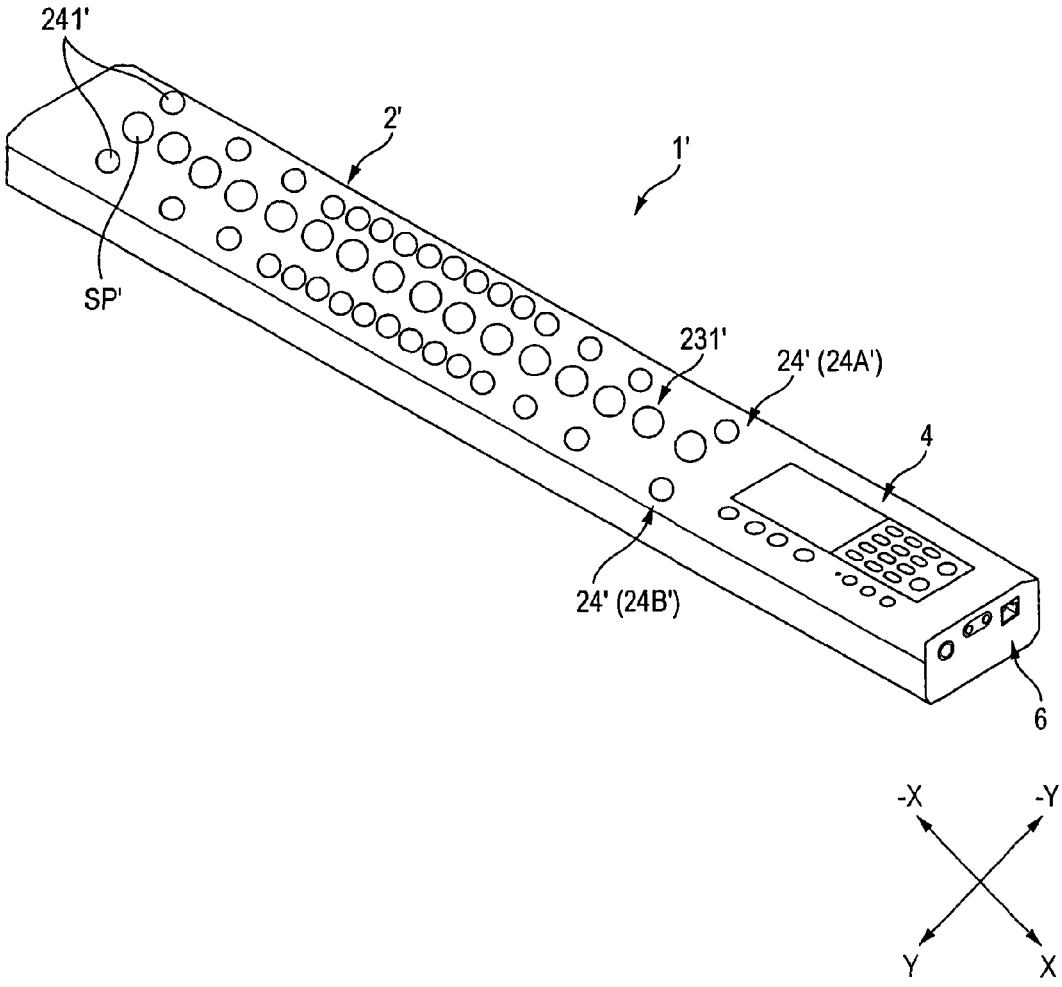
FIG. 8 is a perspective view of a voice signal transmitting/receiving apparatus according to a second embodiment.

A voice signal transmitting/receiving apparatus 1' according to a second embodiment of the invention is described in detail in the following with reference to FIG. 8. FIG. 8 is a perspective view of the voice signal transmitting/receiving apparatus 1' according to the second embodiment. The voice signal transmitting/receiving apparatus 1' includes a device body 2' having an elongated, substantially rectangular parallelepiped shape, a speaker array 231' buried in the upper face of the device body 2' over the longitudinal direction, and microphone arrays 24A' and 24B' arranged in parallel with the speaker array 231' on the two sides of the speaker array 231'.

Since the speaker array 231' is arranged on the upper face, as has been described hereinbefore, the voice beam from the speaker array 231' is outputted upward and is reflected on the ceiling or the like so that it is directed downward. The user listens to the voice beam outputted downward.

The distances between the microphone arrays 24A' and 24B' and the speaker array 231' are made substantially equal.

As in the first embodiment, therefore, the voices to go round to the microphone arrays 24A' and 24B' are made substantially identical. In case the user is located on only one of the −Y-side and the Y-side, the not-shown control unit clears the voice signals collected by the microphone arrays 24', of the voice signals collected by the microphone arrays 24' on the other side, so that the control unit can efficiently cancel the voices having gone round from the speaker array 231'.

Here, the constructions of the speaker array 231' and the microphone arrays 24' are identical to those of the first embodiment, so that their description is omitted, although the individual microphones 241' composing the microphone arrays 24'are not the microphones of the single directivity in the second embodiment.

The voice signal transmitting/receiving apparatus 1' has the connector group 6 arranged on the X-side side face so that it is provided with the function to communicate with the partner voice signal transmitting/receiving apparatus 1'. Moreover, the microphone arrays 24' is buried in the front face (i.e., in the Y-side face) of the voice signal transmitting/receiving apparatus 1' , and the operation unit 4 is buried on the right side (i.e., on the x-side) of the speaker array 231'.

The speaker array 231' and the microphone arrays 24' are so attached to have their sound releasing direction and sound collecting direction directed upward to arrange the sound releasing direction of the speaker array 231' and the sound collecting direction of the microphone arrays 24' in parallel.

According to the constructions thus far described, as in the first embodiment, the second embodiment has advantages that the user can enjoy an excellent operability, that the user can be relatively easily acquainted with the error in the set position, and that the echo cancellation can be effectively made with compactness.

Moreover, the sound releasing direction of the speaker array 231' and the sound collecting direction of the microphone arrays 24'. In case the orienting areas of the sound collection beam and the voice beam are to be made identical, therefore, the setting direction of the voice signal transmitting/receiving apparatus 1' can be so easily adjusted that both the sound collection beam and the voice beam may be efficiently directed to the orienting areas.

Although the first and second embodiments are constituted to have the plural microphone arrays 24 and 24' arranged, the invention should not be limited to those constructions, but it is sufficient to arrange one of the microphone arrays 24A and 24B or one of the microphone arrays 24A' and 24B'.

The invention claimed is:

1. A voice signal transmitting/receiving apparatus comprising:

a device body;

a sound releasing unit arranged in the device body; and a microphone array having a plurality of single-directivity microphones arranged in an array, wherein the sound releasing unit is disposed so that sound emitted from the sound releasing unit is in a direction that is lower in sensitivity to the microphone array, wherein the sound releasing unit is a speaker array having a plurality of arrayed speaker units, wherein an array direction of the microphones and an array direction of the speaker units are parallel to each other, wherein the microphone array and the speaker array are arranged in the device body so that a sound collecting face of the microphone array and a sound releasing face of the speaker array are perpendicular to each other, and the sound collecting direction and the sound releasing direction are directed outwardly, wherein the device body includes a frame for mounting the microphone array, wherein a plurality of peripherally arranged holes are formed in the frame in the periphery of the mounting positions of the individual microphones, wherein the frame is a member having a substantially C-shape with a bent edge that is bent substantially at a right angle on at least one edge in a transverse direction thereof, wherein the speaker array is attached to an upper face of the frame so that a sound releasing direction of the sound releasing unit is directed toward the frame, wherein holes are formed at the positions of the speaker units, wherein the microphone array is buried in the bent edge of the frame over the longitudinal direction so that the sound collecting side is directed outwardly, and wherein the peripherally arranged holes are formed in an end portion of the upper face of the frame on the side of the microphone array and in an edge of the frame where the microphone array is arranged.

2. A voice signal transmitting/receiving apparatus according to claim 1, wherein the device body includes an orienting direction informing unit for indicating either an orienting direction of a sound releasing direction of the speaker array or an orienting direction of a sound collecting direction of the microphone array.

3. A voice signal transmitting/receiving apparatus according to claim 1, wherein the frame is supported at a predetermined level from the mounting face by substantially rectangular leg units disposed on two sides of the frame.

4. A voice signal transmitting/receiving apparatus according to claim 1, wherein the peripherally arranged holes are formed at positions so that voices from the speaker array transmit in a lowest sensitivity direction from the microphone array

* * * * *